US006006828A

United States Patent [19]

Kluth et al.

[11] Patent Number: 6,006,828

[45] Date of Patent: Dec. 28, 1999

[54] APPARATUS FOR THE REMOTE DEPLOYMENT OF VALVES

[75] Inventors: Erhard Lothar Kluth; Malcolm Paul Varnham, both of Alresford, United Kingdom

[73] Assignee: Sensor Dynamics Limited, United Kingdom

[21] Appl. No.: 08/809,553

[22] PCT Filed: Sep. 14, 1995

[86] PCT No.: PCT/GB95/02178

§ 371 Date: Mar. 13, 1997

§ 102(e) Date: Mar. 13, 1997

[87] PCT Pub. No.: WO96/08635

PCT Pub. Date: Mar. 21, 1996

[30] Foreign Application Priority Data

Sep. 16, 1994 [GB] United Kingdom ..... 9418695

[51] Int. Cl.[6] ..... E21B 34/10

[52] U.S. Cl. ..... 166/156; 166/319

[58] Field of Search ..... 166/156, 386, 166/316, 319, 250.01

[56] References Cited

U.S. PATENT DOCUMENTS

| | | | |
|---|---|---|---|
| 2,810,442 | 10/1957 | Tausch . | |
| 3,035,641 | 5/1962 | Page . | |
| 3,361,206 | 1/1968 | Raulins . | |
| 3,656,552 | 4/1972 | Pollack, Jr. et al. . | |
| 4,286,622 | 9/1981 | Ninomiya et al. . | |
| 4,360,063 | 11/1982 | Kilgore . | |
| 4,441,558 | 4/1984 | Welch et al. . | |
| 4,589,495 | 5/1986 | Langer et al. | 166/156 X |
| 5,062,448 | 11/1991 | Hilsenbeck et al. . | |
| 5,146,992 | 9/1992 | Baugh . | |
| 5,582,064 | 12/1996 | Kluth | 166/66 X |

FOREIGN PATENT DOCUMENTS

| | | |
|---|---|---|
| 2088927A | 8/1981 | United Kingdom . |
| 2284257A | 9/1994 | United Kingdom . |

*Primary Examiner*—William Neuder
*Attorney, Agent, or Firm*—Iandiorio & Teska

[57] ABSTRACT

Apparatus for the remote deployment of one or more valves (1), comprising channel means (2) through which the valve (1) will be deployed, channel location means (3) in which the valve (1) will sit, seal means (4) to seal between the valve (1) and the channel means (2), valve location means to seat the valve (1) onto the channel location means (3), and valve means (6) to control the passage of fluid.

8 Claims, 7 Drawing Sheets

APPARATUS FOR THE REMOTE DEPLOYMENT OF VALVES

This invention relates to apparatus for the remote deployment of valves. The invention is particularly relevant in the oil industry where a valve which can be remotely deployable allows such valves to be installed and replaced when required without incurring huge expense.

As oil and gas reserves have been consumed over the years, the extraction of the oil and gas has become increasingly more difficult under more demanding conditions. Accordingly, there is a need for the reserves to be more widely monitored to a higher quality than hitherto, and this is particularly so for oil and gas reserves which lie beneath the sea bed. Optical fibre sensors, together with optical fibre cables to link the sensor to the measurement instrumentation, are being developed for this purpose since they offer specific advantages, particularly in the ability to withstand extremes of high pressure and temperature. Furthermore, such optical fibre sensors may be of a structure and diameter similar to those of the optical fibre cable itself. Sensors are being developed which can be remotely deployed into oil wells through convenient size hydraulic tubing. Communication to the production string (through which the oil is extracted) can be achieved by use of valves which can be opened and closed by means of appropriate control signals (usually electrical or hydraulic). However a problem with this approach is that if the valve were to fail then it would need to be replaced. Unfortunately, conventional methods to do this are expensive, and for subset wells probably prohibitively expensive.

This problem is even more acute when sensors are required to measure parameters past the packer. The packer is the seal surrounding the production string which prevents the reservoir pressure from accessing the annulus. Clearly penetrating the packer with hydraulic channels is potentially dangerous and reliable valves in the hydraulic conduit are therefore required. Again the problem exists as what to do if the valves were to fail.

A different application where expensive replacement of valves is often required in oil wells is with gas lift. Here valves are placed at intervals down the production string (the inner tubing through which the oil flows up out of the ground). The valves connect the inside of the production string to the annulus surrounding the production string. Gas (typically nitrogen) is pumped down the annulus and it enters the production string via gas-lift valves. These valves close in sequence down the production string when the pressure in the annulus exceeds the pressure in the production string. The last valve is left open. Unfortunately, these valves can fail and their replacement is extremely expensive.

An aim of the present invention is to improve on known apparatus by allowing valves to be deployed to awkward locations, and a further aim is to allow the valve to be replaced simply.

According to the present invention, there is provided apparatus for the remote deployment of one or more valves, comprising channel means through which the valve will be deployed, channel location means in which the valve will sit, seal means to seal between the valve and the channel means, valve location means to seat the valve onto the channel location means, and valve means to control the passage of fluid.

The channel means may be any conveniently sized hydraulic tubing, for example ¼" or ⅜" (6 mm or 10 mm).

The channel location means may be a tapered section of hydraulic tubing having a diameter greater than the channel means at one end, tapering down to the same diameter at the other.

The seal means may be fabricated with one or more O-rings to provide a seal between the valve and the channel means.

The valve location means may be based on inserts which spring out when they enter a section of tubing having an increased diameter.

The valve location means and channel location means may of such a design that the valve can be ejected by increasing the flow of fluid through the channel means such that springs are pushed in and the valve is pushed into the channel means.

The valve may be one valve or a combination of valves. These valves may include a non-return valve or valves which can toggle between one state (such as OFF) and another state (such as FULLY ON) when the pressure in the channel means is pulsed. These valves may control the flow of fluid or gas in direction of the channel means, or may control the direction of fluid or gas between the channel means and the outside of the channel means via a hole means located at a suitable point in the channel means.

In an embodiment of the present invention, the channel location means is formed by the going together of first channel means and second channel means where the first channel means has the larger diameter. This allows the valve to be pumped through the first channel means and to locate itself against the channel location means.

The valve may be a non-return valve comprising a ball which seats onto a circular orifice thus preventing flow from the first channel means into the second channel means The ball may be restrained within the valve using a spring.

The valve may contain grid means to allow fluid to flow through the valve.

The valve may be a double non-return valve comprising a ball between two circular orifices thus preventing significant flow in either direction.

In another embodiment of the present invention, the apparatus is one in which the valve contains a floppy tube means, and the valve location means contains one or more metal inserts spring loaded to spring out when the valve enters the channel location means. The floppy tube means may be such that it will allow flow from the valve to the channel means, but which will restrict flow by crumpling up when the flow is in the opposite direction. The floppy tube means may be made from tubing containing one or more elastic rings which allow the tubing to open up when flow is in one direction but to seal the tubing when flow is in the other direction.

In another embodiment of the present invention the valve location means contains autoeject means which can be activated by ejector means on a following valve. The autoeject means may contain a sprung-loaded mechanical slide which when pushed down retracts the valve location means.

In another embodiment of the present invention the channel means contains one or more channel location means and the channel means terminates in bin means for interconnecting into a production string of an oil or gas reservoir via interconnecting means. Valves can be pumped down the channel means to locate into channel location means. Should the valve require replacing, the valve can be ejected from the channel means and be passed to the bin means. The bin means may be a receptical within the annulus of the oil well.

In another embodiment of the present invention, the channel means is a hydraulic conduit which penetrates the packer in an oil well. The hydraulic conduit is wrapped around the production string above the packer. The valve contains a floppy tubing means which will allow optical fibre cable to be pumped through in one direction but will seal onto the fibre when the flow is stopped or reversed.

In another embodiment of the present invention, the channel means is a hydraulic conduit containing one or more channel location means such that valves can be located at each channel location means. The channel means contains connections to the production string below each channel means. When a valve is located at each channel location means, the valve controls the passage of gas or fluid between the channel means and the production tubing. Such an installation can be used for gas lift where nitrogen, methane or other gases is pumped down through the channel means into the production tubing, and the valves turn off sequentially as the pressure in the channel means exceeds the pressure in the production tubing. If valves fail, then the valves can be replaced by pumping new valves down the channel means ejecting each valve in turn which are deposited either into bin means or returned to the surface via a second channel means.

The fluid may be a liquid and/or a gas. Examples are water, hydraulic oil, produced hydrocarbon gas from an oil or gas well such as methane, dry nitrogen or helium.

Embodiments of the invention will now be described solely by way of example and with reference to the accompanying drawings in which.

Figure 1:
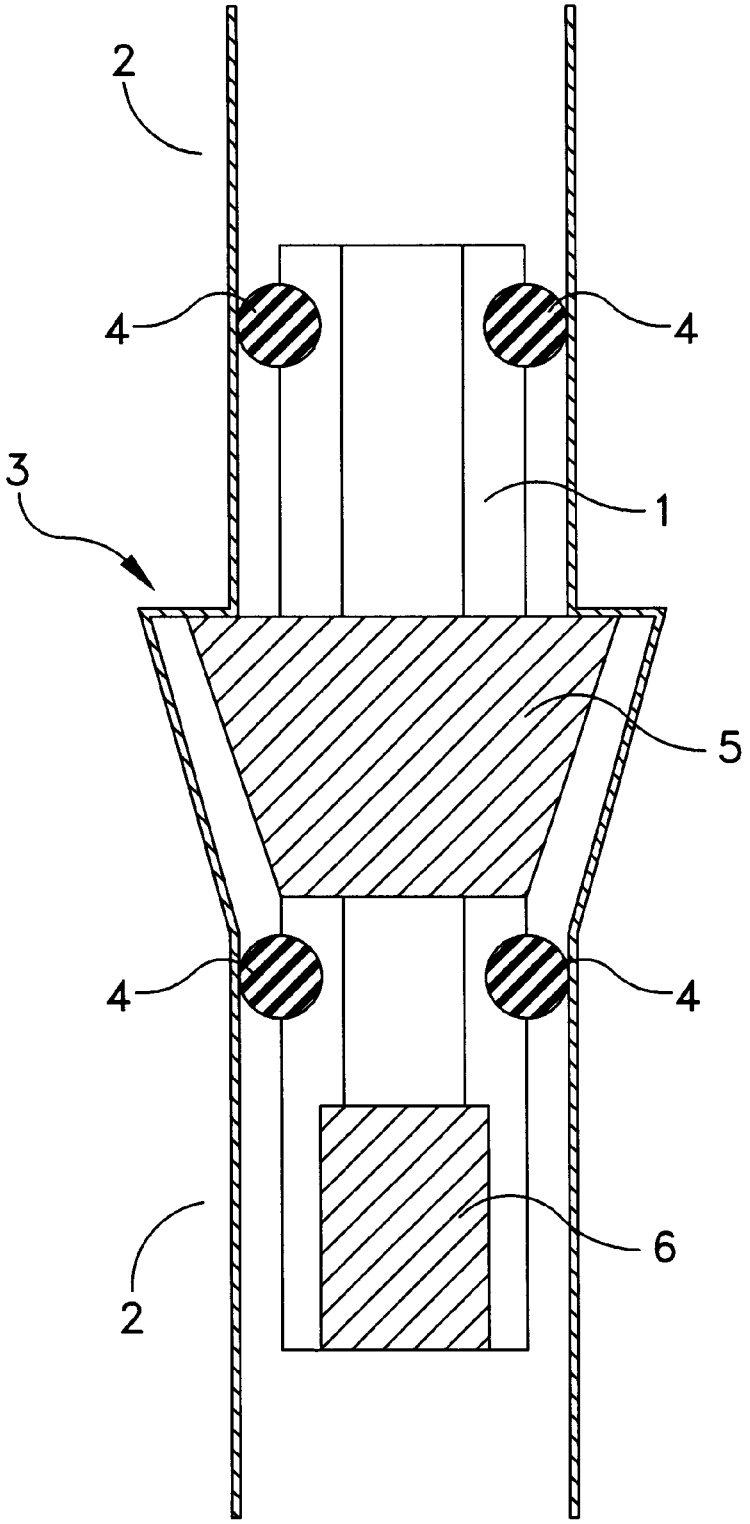
FIG. 1 is a diagram of an embodiment of the present invention in which the channel location means and valve means are separate.

With reference to FIG. 1, a valve 1 has been pumped down channel means 2 until it reached the channel location means 3 whereupon the valve location means 5 engaged into the channel location means 3 thus seating the valve 1 in the desired location. The valve action is provided by the valve means 6 which forms part of the valve 1 and which controls the passage of the fluid or gas within the channel means 2. Also shown in FIG. 1 is an optical fibre sensor 7.

Fluid is prevented from bypassing the valve 1 with sealing means 4 which may be O-rings attached to the valve 1.

The channel location means 3 is shaped such that if the flow of fluid down the channel means 2 is increased, then the valve 1 can be pushed out of the channel location means 3 down the channel means 2. This allows a different valve 1 to be pumped into the vacated channel location means 3.

Figure 2:
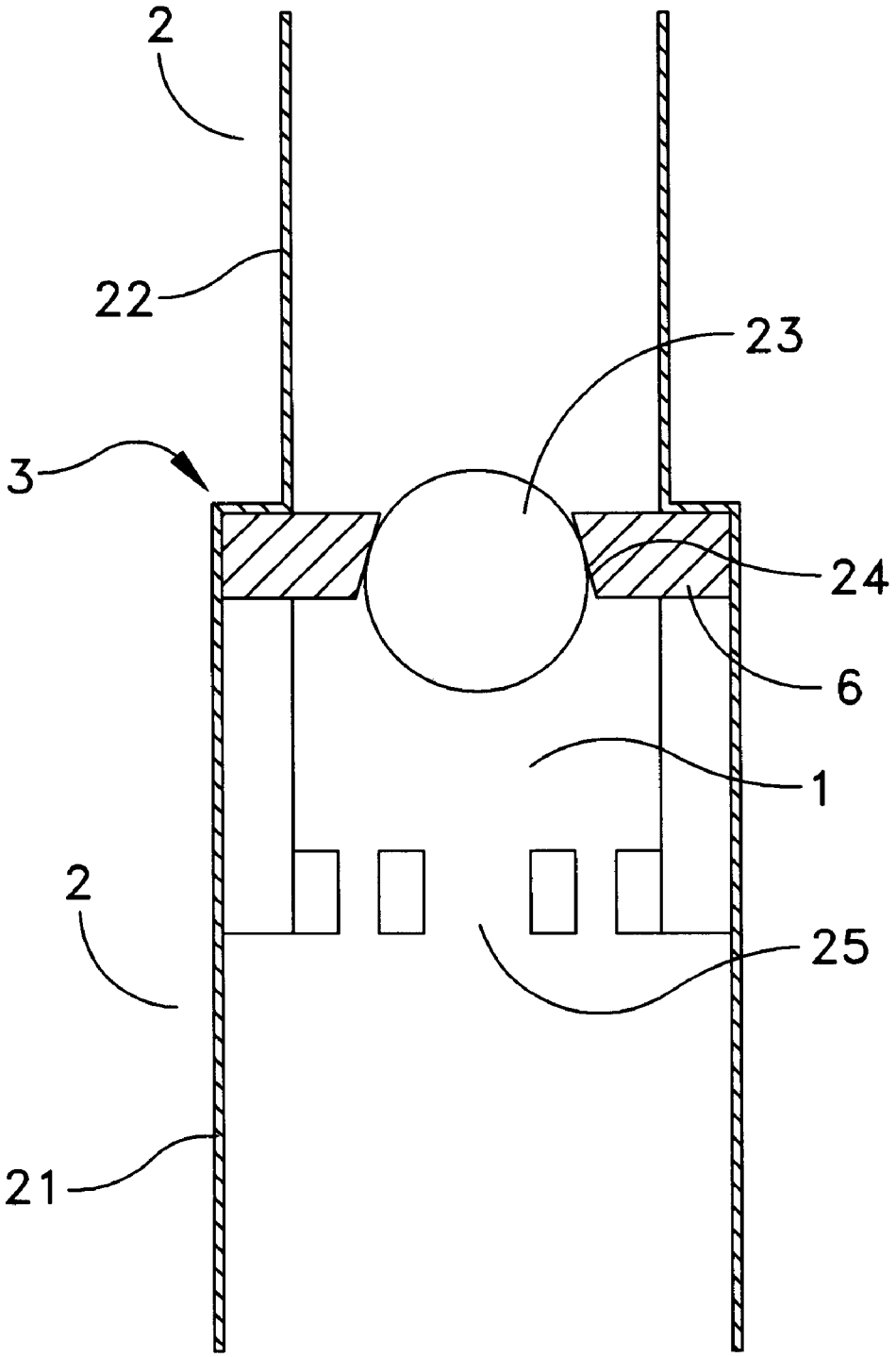
FIG. 2 is a diagram of an embodiment of the present invention where the valve locates itself at the intersection of two channel means of different diameters.

With reference to FIG. 2, the channel means 2 comprises first channel means 21 and second channel means 22 where the first channel means 21 has a larger diameter than the second channel means 22. The channel location means 3 is formed at the intersection of first channel means 21 and second channel means 22. When a valve 1 is pumped through the first channel means 21 it will seat itself onto the channel location means 3. The valve means 6 is a non-return valve formed by a ball 23 which seals against a circular orifice 24 when flow is directed from first channel means 21 towards second channel means 22. Grid means 25 prevents the ball 23 from escaping and allows fluid or gas to pass through the valve means 6.

The first channel means 21 may be ⅜" hydraulic steel line and the second channel means 22 may be ¼" hydraulic steel line as commonly used in the oil and gas industries for the injection of chemicals into wells and hydraulic actuation of downhole components. The joining of the hydraulic lines may be achieved with commercially available unions designed for this purpose—this union would provide the channel location means 3. The valve 1 may have a housing constructed from a flexible medium such as to allow for passage through bends of small radii of the hydraulic steel line. A suitable material for the valve 1 is Viton which is chemically inert, withstands high temperatures, and would provide a suitable seal when seated on to the channel location means 3. All remaining pieceparts in the valve 1 may be made from a steel alloy such as 13 chrome steel alloy, the exact choice of material depending on the chemical environment of the specific oil or gas well.

Such valves 1 would allow pressure communication through the valve means 6 without allowing significant flow. Such a pumpable valve 1 would be useful as a pressure barrier in oil or gas wells between production tubing and hydraulic steel control line containing one or more sensors (such as optical fibre pressure sensors, optical fibre temperature sensors, or optical fibre acoustic sensors) which may be pumped through the same control line. In this application, pressure communication is required from the production tubing to the pressure sensor in order for a pressure measurement to be made. However it is also important that there is a pressure barrier to prevent significant fluid flowing from the production tubing through the control line to the atmosphere.

The ability to replace the valve 1 is important in measurement applications involving pumping sensors through hydraulic control lines in oil and gas wells because valves are known to corrode or otherwise degrade. The ability to eject the valve 6 by pumping it into the production tubing of an oil or gas well, pump out a fibre sensor previously installed in the control line, and then replace both the valve 6 and the sensor by pumping new ones in, offers significant economic advantages over existing methods, particularly in the replacement of valves and sensors in subsea oil or gas wells.

Figure 3:
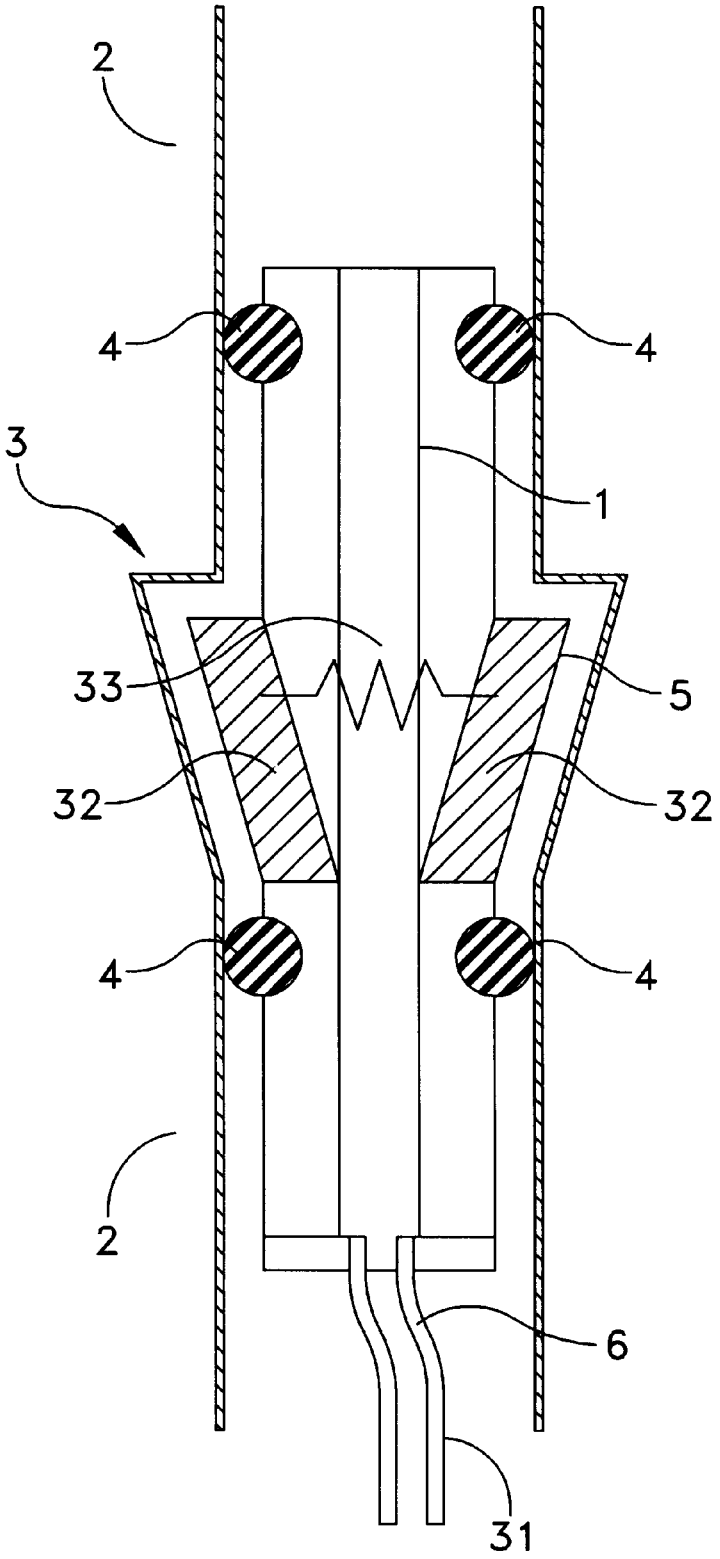
FIG. 3 is a diagram of an embodiment of the present invention with details of a valve location means and details of a floppy valve.

With reference to FIG. 3, the valve means 6 is a floppy tube means 31 held open on its attachment to the valve 1. The floppy tube is such that it opens when flow is directed from the valve 1 to the channel means 2, but restricts flow or even seals by collapsing onto itself when there is a pressure gradient in the opposite direction. The valve location means 5 comprises one or more metal insert means 32 spring loaded with spring means 33 which push the metal insert means 32 sideways when the valve 1 enters the channel location means 3.

Figure 4:
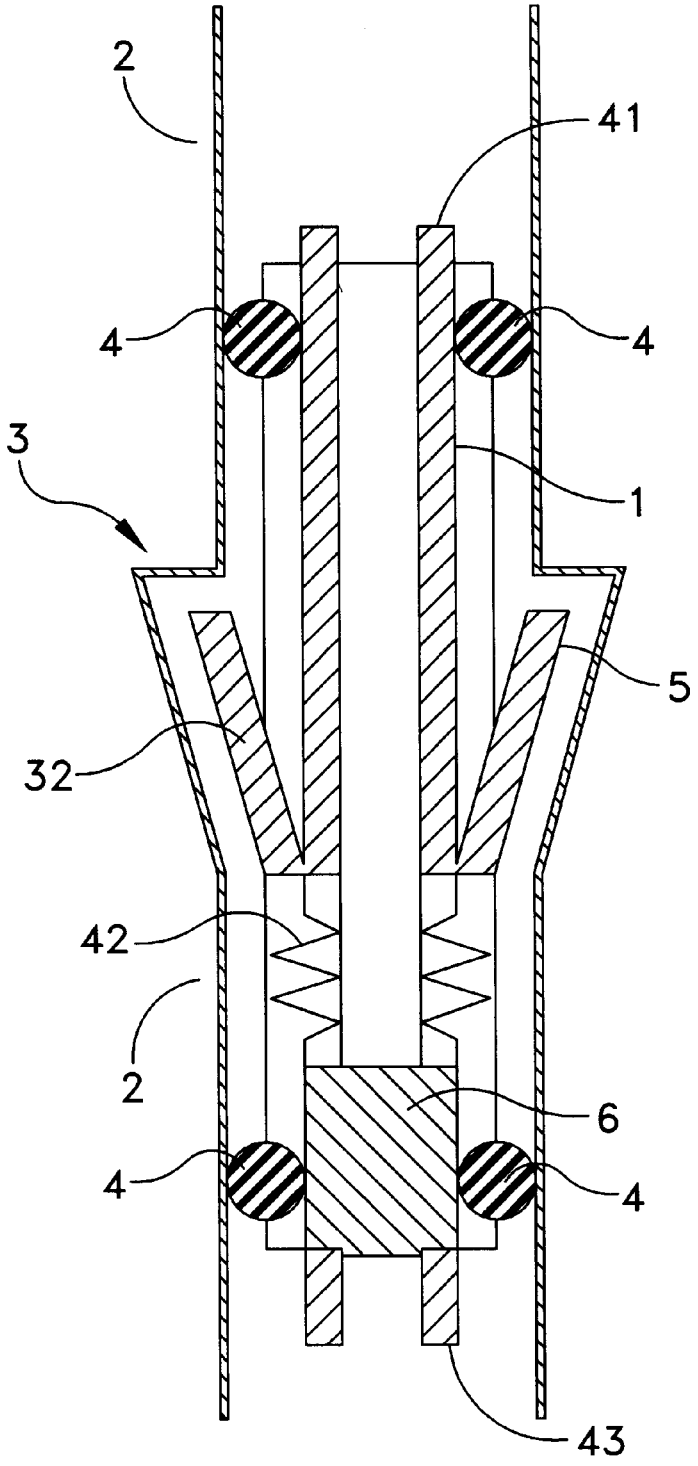
FIG. 4 is a diagram of an embodiment of the present invention containing an autoeject mechanism.

With reference to FIG. 4, the valve location means 5 contains an autoeject means comprising a slide means 41 and spring means 42. When a new valve is pumped down, the ejector means 43 pushes against the slide means 41 compressing the spring means 42. This action retracts the metal insert means 32 releasing the valve such that it can be ejected from the channel location means 3.

Figure 5:
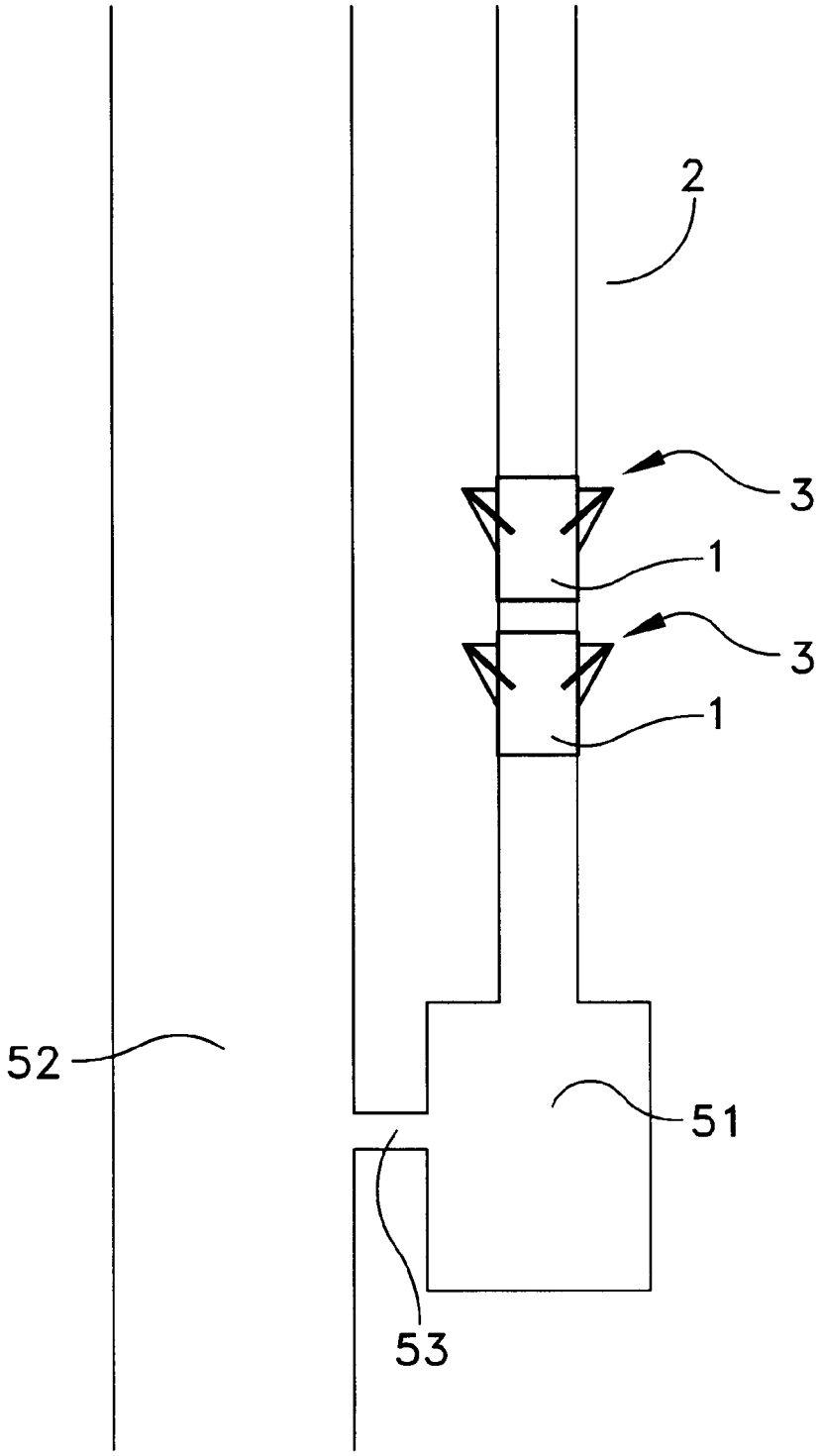
FIG. 5 is a diagram of an embodiment of the present invention where the channel means interconnects to a production string of an oil well.

With reference to FIG. 5, the channel means 2 contains two channel location means 3 into which valves 1 can be deployed. The channel means 2 terminates in a bin means 51 which interconnects into a production string 52 via an interconnection means 53. When valves 1 need to be replaced, they can be ejected from the channel location means 3 into the bin means 51, and new valves pumped down into the vacated channel location means 3.

Figure 6:
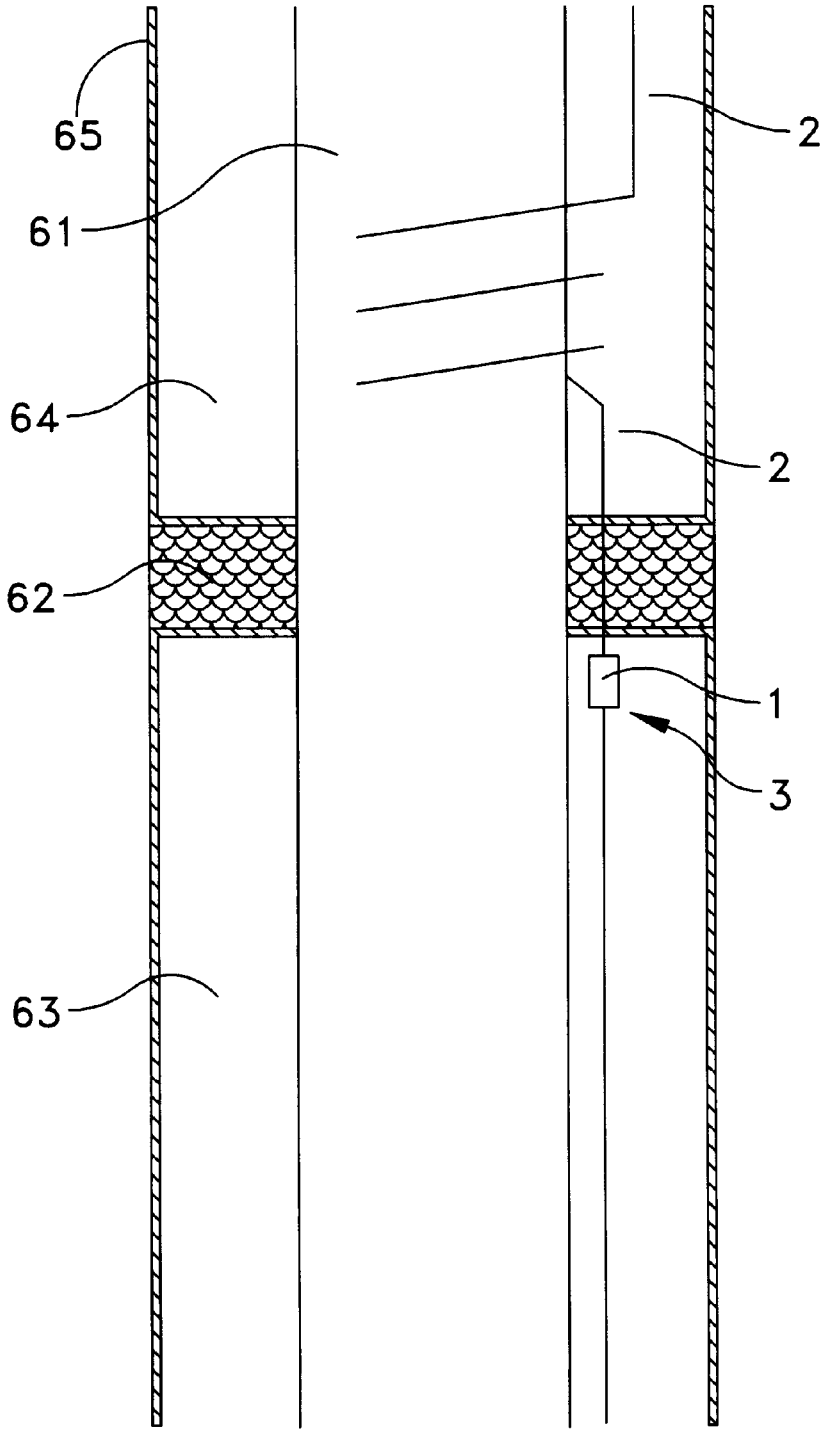
FIG. 6 is a diagram of an embodiment of the present invention where the channel means penetrates a packer of an oil well.

With reference to FIG. 6, the channel means 2 is wrapped around the production string 61 above the packer 62 which seals the reservoir environment 63 from the anulus 64 between the production string 61 and the casing 65 of the oil well. The channel means 2 penetrates the packer 62 and continues down into the reservoir. A channel location means 3 is situated below the packer 62 (although this might alternatively be within or above the packer 62) into which a valve 1 can be deployed. The valve 1 contains a floppy tubing means 31 designed to allow optical fibre sensors to be pumped through into the channel means 2 below the packer 62. The floppy tubing means 31 is such that flow is prevented from reversing.

Figure 7:
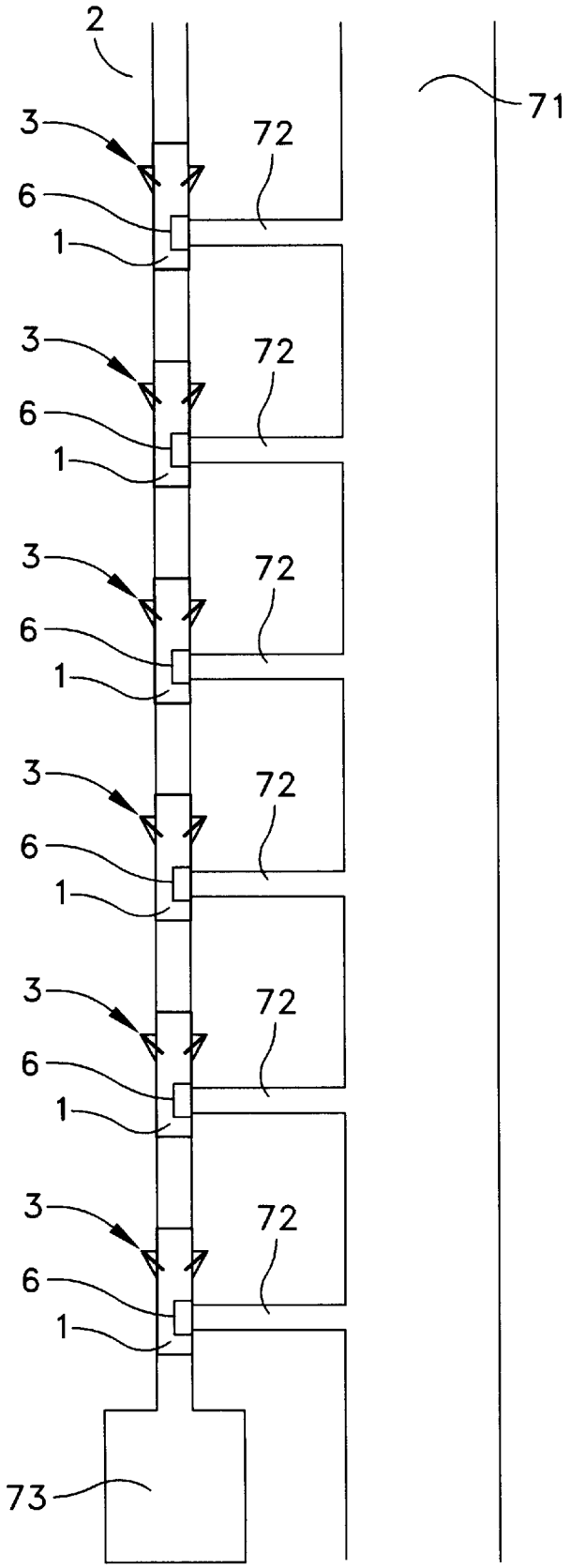
FIG. 7 is a diagram of an embodiment of the present invention where the valve means interconnects to production tubing of an oil well thus allowing gas lift to be implemented.

With reference to FIG. 7, channel means 2 interconnects to the production string 71 of an oil or gas well via several interconnection means 72. Valves 1 are pumped down to locate into the channel location means 3 such that the valve means 6 control the passage of fluid and or gas between the channel means 2 and the production tubing 71. If valves 1 need to be replaced then valves 1 having an autoeject mechanism 41 are pumped down the channel means 2 ejecting each valve 1 in turn. Unwanted valves 1 are deposited into bin means 73. The valve means 6 are designed to prevent flow of gas from the channel means 2 into the production string 71 when the pressure in the channel means 2 exceeds the pressure in the production string 71.

It is to be appreciated that the embodiments of the invention described above with reference to the accompanying drawings have been given by way of example only and that modifications and additional components may be provided to enhance the performance of the apparatus.

We claim:

1. Apparatus for sensing one or more parameters, which apparatus comprises:

at least one valve;

at least one optical fibre sensor;

channel means through which the valve and the optical fibre sensor are pumped to a predetermined location;

channel location means for retaining the valve at the predetermined location;

valve location means for seating the valve onto the channel means; and a sealing arrangement for sealing the valve and the channel means;

and the apparatus being such that the valve controls passage of fluid through the channel means.

2. Apparatus according to claim 1 in which the channel means is hydraulic tubing.

3. Apparatus according to claim 1 in which the channel means has a section having an increased diameter, and in which the valve location means contains inserts which spring out when they enter the section having the increased diameter.

4. Apparatus according to claim 3 in which the valve location means and the channel location means are such that the valve is able to be ejected from the channel location means by increasing flow of fluid through the channel means such that the inserts are forced in, whereby the valve is able to be pumped along the channel means.

5. Apparatus according to claim 1 in which the valve location means contains autoeject means which is able to be activated by ejector means on a following valve.

6. Apparatus according to claim 1 in which the channel means is a hydraulic conduit which penetrates a packer in an oil well.

7. Apparatus according to claim 6 in which the hydraulic conduit is wrapped around a production string above the packer.

8. Apparatus according to claim 1 in which the valve contains floppy tubing which allows the optical fibre sensor to be pumped in one direction, but which seals onto the optical fibre sensor when flow is stopped or reversed.

* * * * *